United States Patent [19]

Niedecker

[11] 4,393,641

[45] Jul. 19, 1983

[54] DEVICE FOR CLOSING GATHERED ENDS OF WRAPPERS WITH U-SHAPED CLIPS

[76] Inventor: Herbert Niedecker, Am Ellerhang 6, Königstein 2, Fed. Rep. of Germany, 6240

[21] Appl. No.: 265,272

[22] Filed: May 20, 1981

[30] Foreign Application Priority Data

May 29, 1980 [DE] Fed. Rep. of Germany ..... 3020325

[51] Int. Cl.[3] ..... B65B 61/00

[52] U.S. Cl. ..... 53/138 A; 140/93 A; 53/583; 29/33.5

[58] Field of Search ..... 53/138 A, 378, 482, 53/483, 583; 29/33.5, 33.52, 243.57; 227/155; 140/93 A

[56] References Cited

U.S. PATENT DOCUMENTS

| | | | |
|---|---|---|---|
| 2,756,428 | 7/1956 | Kellersman | 72/403 |
| 3,717,972 | 2/1973 | Niedecker | 53/138 A |
| 3,914,980 | 10/1975 | Niedecker | 72/410 |

FOREIGN PATENT DOCUMENTS 2318125 10/1974 Fed. Rep. of Germany .

*Primary Examiner*—Daniel C. Crane
*Assistant Examiner*—Linda McLaughlin
*Attorney, Agent, or Firm*—Sprung, Horn, Kramer & Woods

[57] ABSTRACT

In a device for closing a U-shaped clip about the gathered end of a wrapper and comprising a housing carrying a clip-closing die and, a punch pivotally mounted on the die to move from inoperative to clip-closing position in cooperation with the die, the improvement which comprises (a) a wedge shaped opening provided in one end face of the housing, the opening widening adjacent the apex to form a space for receiving the gathered end; (b) two gathering arms pivotally mounted on the housing on opposite sides of the wedge-shaped opening so that, upon pivoting, a gathered end within the opening is caused to enter the receiving space; and (c) a gathering nose on the punch; the punch being pivoted, only after the gathering arms have been closed, so that the nose engages and further compacts the gathered end against the die whereupon the punch applies the clip about the gathered end, the clip being closed by the die.

4 Claims, 3 Drawing Figures

DEVICE FOR CLOSING GATHERED ENDS OF WRAPPERS WITH U-SHAPED CLIPS

This invention relates to a device for closing gathered ends of wrappers with U-shaped clips.

U.S. Pat. No. 3,914,980, the disclosure of which is incorporated herein by reference, discloses a device for closing gathered ends of wrappers with U-shaped clips. In that apparatus, tong arms are forced together so that the clip is advanced by a punch and is applied around the gathered end of the wrapper and closed against a die around the gathered end of the wrapper. The punch is pivotally movable about a fulcrum and is adapted to be driven by means of toggle joints and cams so that the transmission ratio between the tong handle and punch is initially high and subsequently low. Whereas the gathering and closing operation can be performed with only one hand by a single closing of the tongs without need for further manual operations, that device can be used only to close relatively small bags and sacks because with relatively large bags or sacks the gathering will require a much greater effort and a previous gathering will be required.

The tonglike device which has been described in German Patent Publication No. 2,318,125 and serves to close a wrapper is not suitable for relatively large bags or sacks, for the same reason.

It is an object of the invention to provide a power-driven device for gathering and closing bulky gathered ends of relatively large bags or sacks with U-shaped clips. The device should be easily operable and have a high performance.

This object is accomplished according to the invention by the combination of the following features:

(a) A wedge-shaped opening provided at the end face of a housing and widening adjacent to its apex to form a space for receiving the gathered end;

(b) Two gathering arms, which are mounted on the housing on both sides of the wedge-shaped opening and pivoted on pins and serve to introduce the pre-gathered end into the receiving space;

(c) A gathering punch, which is provided with a gathering nose and mounted for rotation on a pivot and has a trough-shaped recess for receiving the clip; when the gathering arms have been closed and the gathering punch is actuated, the gathering nose of the gathering punch engages and further compacts the gathered end and at the same time applies the clip around the gathered end and then causes the clip to be closed against a die provided on the opposite side of the receiving space;

(d) Drive means for pivotally moving two cam plates about a pivot; one of the cam plates actuates the gathering arms, the other cam plate actuates the gathering punch;

(e) Cam slots, which constrain the cam plates to move in such a manner that the gathering punch will not be actuated until the gathering arms have been closed; the motions of the cam plates being transmitted by toggle levers.

The device according to the invention affords the advantage that gathered ends of relatively large bags are introduced by gathering arms into the gathering space through the wedge-shaped opening and are then compacted by the gathering nose of the gathering punch to such an extent that the U-shaped clip can be closed around the gathered end without damage to the wrapper. The device can be moved in a fast and safe manner to the gathered end that is to be closed; one hand holds the gathered end to be closed and the other hand pushes the wedge-shaped opening of the device over the gathered end to such an extent that the hand that holds the gathered end actuates a pushbutton for triggering the device. In this way a higher performance is achieved.

In another embodiment of the invention, transfer rollers are provided on the housing on both sides of the wedge-shaped opening. Owing to that arrangement a bulky gathered end of a relatively large bag or sack can be introduced more easily into the wedge-shaped opening of the device according to the invention.

According to a preferred further feature of the invention, the transfer rollers are provided with teeth in order to prevent a slipping of the transfer rollers on the wrapper.

An illustrative embodiment of the invention is shown in the drawings and will now be described more in detail.

Figure 1:
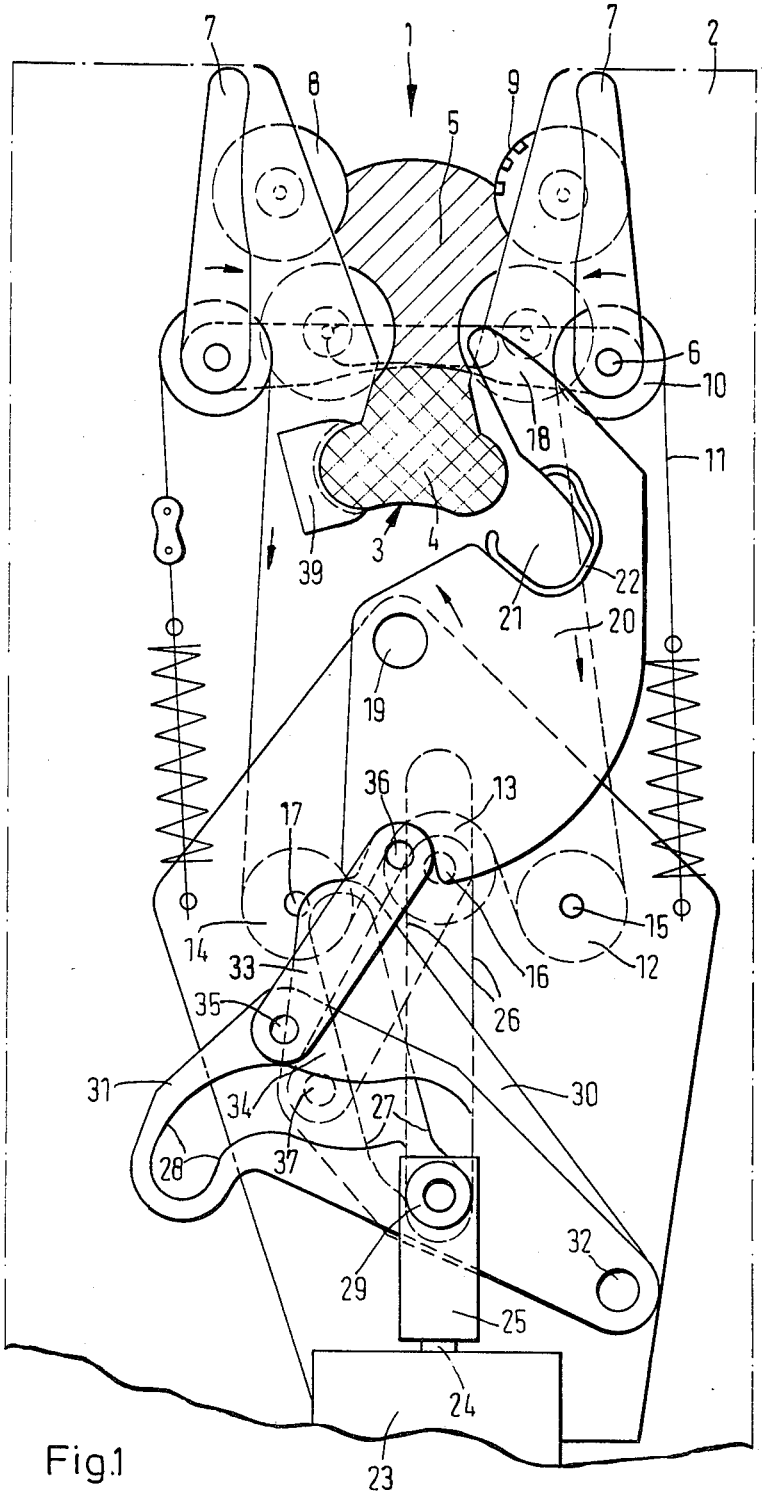
FIG. 1 is a top plan view showing a device according to the invention in a position for receiving the gathered ends, with opened gathering arms.

In the top plan view of FIG. 1, the device according to the invention is shown to have a wedge-shaped opening 1 on the end face of the housing 2. Adjacent to its apex, the wedge-shaped opening 1 widens to form a space 3 for receiving the gathered end 4.

Gathering arms 7 are mounted on the housing 2 on both sides of the wedge-shaped opening 1 and are pivoted on pins 6 and can be closed to move the pre-gathered end 5 into the receiving space 3. In that operation the gathering arms 7 force the pre-gathered end 5 into the receiving space 3 to a large extent, as is indicated by the closed gathering arms 7 represented by dotted lines. Transfer rollers 8 are provided to facilitate the entrance of the loosely manually gathered end of the wrapper into the wedge-shaped opening 1 and have teeth 9, which move in rolling contact without a need for extraneous drive means as the end of the wrapper is introduced. In this way the pre-gathered end 5 is formed. The teeth 9 of the transfer rollers 8 prevent a slipping of the transfer rollers 8 on the wrapper as the latter is introduced.

Chain sprockets 10 mounted on the pins 6 are driven by a chain 11, which is trained also around chain sprockets 12, 13, 14 rotatably mounted on respective pins 15, 16 and 17. Springs 38 urge the gathering arms 7 apart.

As is apparent from FIG. 1, the device comprises a gathering punch 20, which is rotatably mounted on a pivot 19 and provided with a gathering nose 18 and with a trough-shaped recess 21 for receiving the clip 22.

A drive 23 is connected by a piston rod 24 to a yoke 25, which moves along a track 26. The drive 23 serves to impart a pivotal movement to two cam plates 30, 31 about the pivot 32 by means of cam follower rollers 29, which are guided in cam slots 27, 28. These have such a configuration that the force exerted by the drive 23 is initially transmitted to the gathering arms 7 and subsequently to the gathering punch 20. The cam slots 27, 28 constrain the cam plates 30, 31 to move in such a manner that the gathering punch 20 will not be actuated until the gathering arms 7 have been closed. The motions of the cam plates 30, 31 are transmitted by toggle levers 33, 34. The toggle lever 33 is pivoted on pivots 35 and 36. The toggle lever 34 is pivoted on pivots 37 and 16. The cam slot 27 for the gathering arms 7 is so designed that the latter have pivotally moved through about 90° before the gathering punch 20 is moved.

Figure 2:
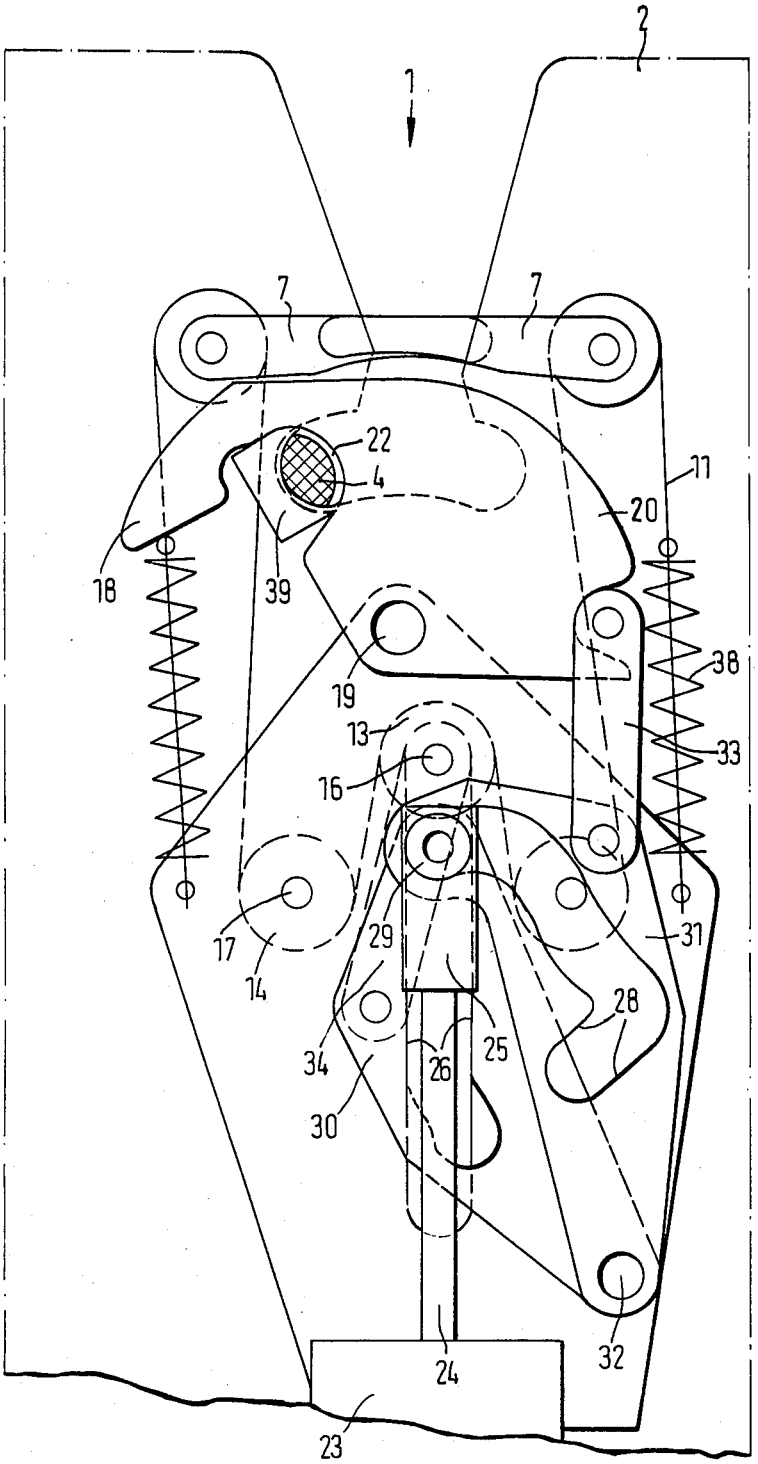
FIG. 2 is a top plan view showing the device according to the invention with the gathering arms closed and the gathering punch in closing position.

FIG. 2 is a top plan view showing the device according to the invention with the gathering arms 7 closed and the gathering punch 20 in closing position. As the gathering punch 20 is actuated, its gathering nose 18 engages the gathered end 4 and compacts it further and applies the clip 22 around the gathered end 4 without damaging the latter. The clip 22 is subsequently closed against a die 39, which is provided on the opposite side of the receiving space 3.

Figure 3:
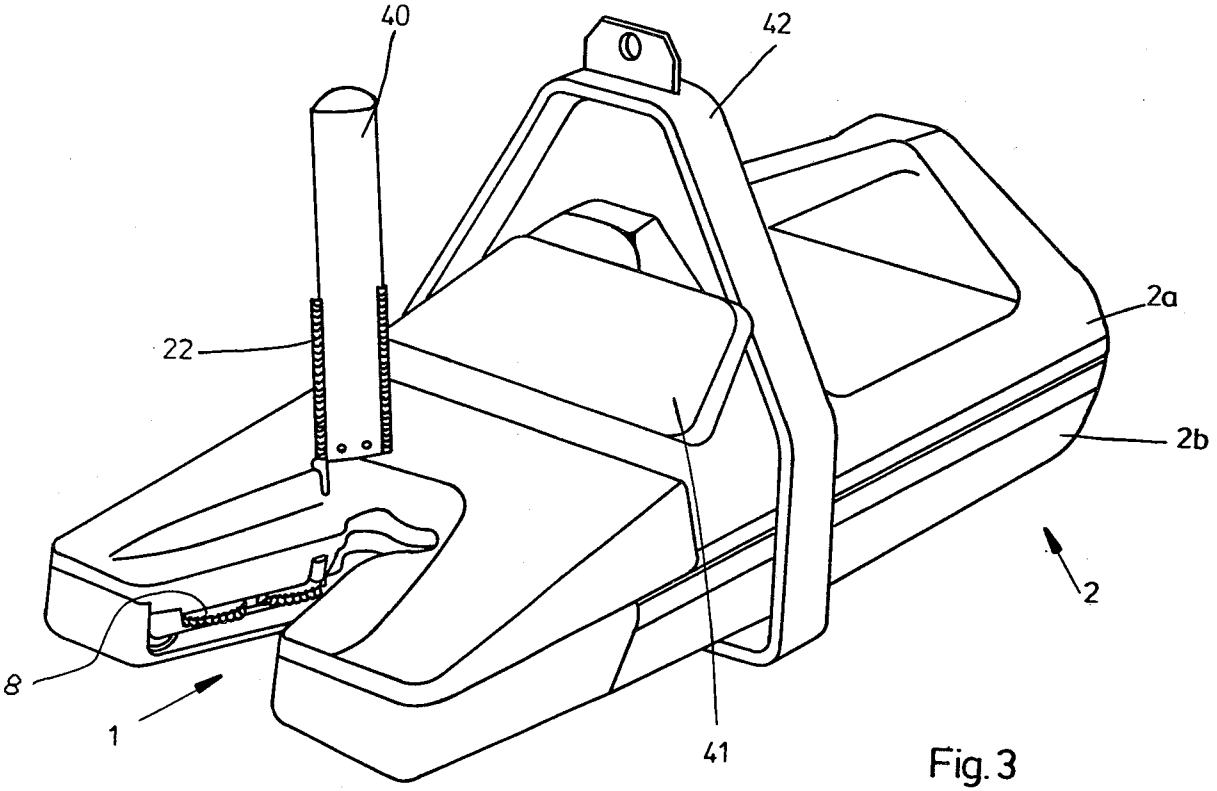
FIG. 3 is an isometric view showing the full device in operative position.

In the isometric view of FIG. 3 it can be seen that the housing 2 has a top 2*a* and a bottom 2*b*. There is shown a stack of clips 22 on a post 40 and an actuatorf 41 which serves to actuate a compressed air supply (not shown) so as to advance drive 23 and effect the closing. The operator pushes actuator 41 with his hand holding the gathered mouth; this ensures that it will not be actuated until his hand moves sufficiently rearward from the opening 1, meaning that gathering has been completed.

About housing 2 is a frame 42 by means of which the device can be suspended in space or bolted to a table.

It will be understood that the specification and examples are illustrative but not limitative of the present invention and that other embodiments within the spirit and scope of the invention will suggest themselves to those skilled in the art.

I claim:

1. In a device for closing a U-shaped clip about the gathered end of a wrapper and comprising a housing carrying a clip-closing die, a punch pivotally mounted on said die to move from inoperative to clip-closing position in cooperation with said die, means for supplying clips to said punch, and means for moving said punch from inoperative to clip-closing position, the improvement which comprises (a) a wedge shaped opening provided in one end face of the housing, the opening widening adjacent its apex to form a space for receiving the gathered end;

(b) two gathering means pivotally mounted on the housing on opposite sides of the wedge-shaped opening so that, upon pivoting, a gathered end within the opening is caused to enter the receiving space;

(c) a gathering nose on the punch; and (d) means operatively connecting the gathering arms and the punch so that only after the gathering arms have been closed the punch is pivoted so that the nose engages and further compacts the gathered end against the die whereupon the punch applies the clip about the gathered end, the clip being closed by the die.

2. A device according to claim 1, wherein the operatively connecting means (d) comprises (e) two cam plates mounted on the housing for pivotal movement, one plate actuating the gathering arms and the other actuating the gathering punch, each plate being provided with a cam slot controlling the movement of the cam;

(f) drive means for pivotally moving the cam plates;

(g) a pair of toggle levers respectively connecting the cam plates with the gathering arms and the punch for moving said punch from inoperative to clip-closing position sequentially to effect gathering and clip-closing.

3. A device according to claim 1, including a pair of transfer rollers mounted on the housing on both sides of the wedge shaped opening to facilitate entry into said opening.

4. A device according to claim 3, wherein the said transfer rollers are toothed.

* * * * *